United States Patent [19]

Mueller

[11] Patent Number: 4,971,684

[45] Date of Patent: Nov. 20, 1990

[54] COMPACT MACHINE AND PROCESS FOR PREPARATION PRIOR TO DRY-GRINDING OF GRAIN TYPE FOODSTUFFS AND FEEDSTUFFS

[75] Inventor: Roman Mueller, Niederuzwil, Switzerland

[73] Assignee: Gebruder Buhler AG, Uzwil, Switzerland

[21] Appl. No.: 249,568

[22] PCT Filed: Dec. 1, 1987

[86] PCT No.: PCT/EP87/00747

§ 371 Date: Sep. 22, 1988

§ 102(e) Date: Sep. 22, 1988

[87] PCT Pub. No.: WO88/04203

PCT Pub. Date: Jun. 16, 1988

[30] Foreign Application Priority Data

Dec. 1, 1986 [CH] Switzerland ..... 04780/86

[51] Int. Cl.[5] ..... B07B 9/00; B03B 4/00

[52] U.S. Cl. ..... 209/44; 209/467

[58] Field of Search ..... 209/2, 12, 19, 20, 44, 209/44.1, 44.2, 466, 467

[56] References Cited

U.S. PATENT DOCUMENTS

| | | | |
|---|---|---|---|
| 43,026 | 6/1864 | Higley | 209/44 X |
| 984,866 | 2/1911 | Tate | 209/467 |
| 1,548,536 | 8/1925 | macartney | 209/44 |
| 1,667,331 | 4/1928 | O'Toole | 209/44 |
| 2,040,196 | 5/1936 | Berrisford | 209/467 |
| 2,332,183 | 10/1943 | Stump | 209/44 X |
| 2,358,293 | 9/1944 | Kendall et al. | 209/466 |
| 2,449,007 | 9/1948 | Paul | 209/19 |
| 2,722,312 | 11/1955 | Gear | 209/19 |

FOREIGN PATENT DOCUMENTS

| | | |
|---|---|---|
| 0330047 | 8/1903 | France . |
| 0711465 | 9/1931 | France . |
| 1099906 | 9/1955 | France . |
| WO85-05050 | 11/1985 | PCT Int'l Appl. . |
| 0096318 | 10/1922 | Switzerland . |
| 0270243 | 8/1950 | Switzerland . |
| 2040190 | 8/1980 | United Kingdom . |

*Primary Examiner*—Margaret A. Focarino
*Assistant Examiner*—Edward M. Wacyra
*Attorney, Agent, or Firm*—Darby & Darby

[57] ABSTRACT

A size grading unit and a gravity grading unit in a grinding preparation installation form an oscillating unit and are arranged one above the other so that a V-shaped space exists between them. The product flow transfers as a carpet or veil falling from the size grading unit at the V apex to the gravity grading unit located below. Air flows through the V-shaped space but not through the size grading unit.

14 Claims, 5 Drawing Sheets

COMPACT MACHINE AND PROCESS FOR PREPARATION PRIOR TO DRY-GRINDING OF GRAIN TYPE FOODSTUFFS AND FEEDSTUFFS

BACKGROUND OF THE INVENTION

The invention is directed to an arrangement for dry grinding preparation of grain type foodstuffs and feedstuffs, such as grain, particularly for cleaning, separating into different fractions and preferably for sorting out foreign matter such as sand, stones, and other inclusions, which comprises a size grading unit, e.g. screens, as well as a gravity grading unit, e.g. as a stone sorter, light grain sorter, etc.

The quantity of specialized machines in a milling installation, also known as a mill, for dry grinding preparation of grains, also known as cleaning, has decreased sharply in recent years. On the other hand, a group of standard units, such as screening devices and stone sorters, as well as light grain sorters to an increasing extent, are to be found in almost every new milling installation. Every unit or apparatus, respectively, is conceived with consideration to its specific task and is provided with suction air, vibrators, etc. The very specific design makes it possible to use the required air, as well as the oscillating energy, in a determined manner and at the lowest possible costs for construction and operation, so that an increased throughput capacity and a higher work quality can be achieved at the lowest possible installation costs in comparison with previous practice.

The majority of milling installations being constructed at present comprise four adjacent building sections, a first for the silo, a second for the grinding preparation, a third for the grinding or milling, and a fourth for the finished products.

The machines for grinding preparation, as well as those for grinding, are distributed on four or five floors. According to desired storage capacities, the storage silos usually rise above the mill buildings. A natural feature of storage silos, namely the discharge through openings in the floor with a corresponding downward movement of the product as a result of gravitational force, has likewise been made use of for many decades in machines for dry grinding preparation. In this case, also, the product is fed into the machines on the uppermost floor so as to move downward floor by floor and from one machine to the other, respectively, only by means of the force of gravity, i.e. without the technical application of additional energy for transport.

Every milling specialist knows that the grinding preparation, particularly the dry grinding preparation (cleaning, separating, sorting, etc.) of the raw material must be accorded as much attention as the grinding itself. This is demonstrated in the fact that in most milling installations space is provided for the grinding preparation/cleaning machines to a sufficient extent that no immediate need for a further concentration of same is known.

A fundamental disadvantage in dry grinding preparation results from the floorwise connection of the grinding preparation machines That is, for the sorting, grading and separating process, the entire product or material flow is fed to the respective machine in a planar thin layer or a thin falling veil. The product flow is bunched together again for transfer to the next machine and then spread out once again in a planar manner after the transfer.

A specially designed inlet portion is used for the uniform planar formation of a product bed. This is to prevent the initial part of the machine from being poorly utilized for the work demanded of it with respect to surface area.

The idea of arranging one machine next to the other in a row on the same floor has often been toyed with. From the point of view of working quality, this would be an advantage. However, since every machine requires different optimum conditions, this would require transition pieces which would be costly in terms of design, particularly when the adjacent machines oscillate in the direction of one another. It has been shown repeatedly in process technology that machines with large surface-area dimensioning are difficult to control. Disturbances are detected at a late stage, so that a small disturbance in one stage can often have disadvantageous consequences for the subsequent stage over a longer period of time.

SUMMARY OF THE INVENTION

The invention is concerned with the problem of improving dry grinding preparation, preferably in such a way as to make possible a concentration of work processes while maintaining, if possible, the ability to oversee every stage, the possibility of influencing every work stage and, in particular, while achieving a throughput capacity and working quality at least equal to that achieved previously.

The solution, according to the invention, is characterized in that the size grading unit and the gravity grading unit in the grinding preparation installation mentioned in the beginning form an oscillating group and are arranged one above the other in a fork-shaped or V-shaped manner, so that a fork-shaped or V-shaped space exists between them; means are provided for transferring the product flow in the manner of a product carpet or veil falling from the size grading unit at the forking point to the gravity grading unit located below the latter; and, finally, means are provided for producing an air flow through the fork-shaped or V-shaped space, but not through the size grading unit.

It is often the case with new inventions, that one wonders later why the simplest and optimum solution was not already applied long ago. One searches for reasons why others active in that specialized area did not arrive at the idea of the inventor. Gravity grading devices require a very strong aeration for the formation of a fluidized bed. On the other hand, actual screens may only be slightly aspirated, since, otherwise, portions are lifted easily and float away on the surface of the flowing loose bulk material. Two decisive advantages result simultaneously by means of arranging the size grading unit and the gravity grading unit one above the other in a fork-shaped manner. The product transfer from the above-located size grader (screen) to the gravity grader located below the latter is effected in a uniform manner along the entire width of the screen; this means that the aforementioned repeated changing between the planar product flow and the product flow which is bunched together in the shape of a pipe is now entirely dispensed with in all (three) basic operations, that is, size grading (screening) and gravity grading, which in this case includes dividing light from heavy and stone sorting.

A planar uniform product layer need only be produced at the (first) entry point of the product into the "compact arrangement", according to the invention. Afterward, it need only be maintained.

Accordingly, the invention makes it possible to meet the proposed object in an impressive manner and with the simplest means and, additionally, enables an even better utilization of the work surfaces.

In principle, the size grading unit and the gravity grading unit can each be provided with its own oscillating drive. But the oscillating group formed from the size and gravity grading units preferably comprises a joint oscillating drive, so that an identical oscillation (identical direction, frequency and amplitude) is imparted to the two units. The oscillating drive is preferably arranged on both sides of the oscillating group, approximately on a horizontal axis of gravity, in such a way that a throw-type oscillation for upward transport is produced for the gravity grading and, on the other hand, a throw-type oscillation for downward transport is produced for the size grading. All working surfaces accordingly carry out an optimum oscillating movement in principle. Tests have confirmed that an accurate separating process is made possible by the new idea, even with high throughput capacities.

In another advantageous construction, the means for generating air flow comprise a base which terminates the size grading unit (screening device), wherein a suction fan is preferably connected at the widened side of the aspiration space between the size grading unit and the gravity grading unit. The screening portion can easily be separated from the fluidized bed with respect to the air by means of arranging the closed base below the screen.

In a particularly preferred construction, the aspiration space, which is made wider on one side, is divided into at least two exhaust chambers, namely an upper and a lower exhaust chamber, wherein adjustable air throttles are assigned to each exhaust chamber.

Accordingly, the distribution of air to the gravity grader can be regulated to any desired accuracy in a very simple manner without negatively influencing in any way the size grading unit located above it. Thus, every individual operation can be maximized according to its requirements.

However, the invention allows various other very advantageous constructions. Thus, for example, the lower end of a light grain sorter can open directly into a vertical aspiration duct in order to be able to sort out a light fraction from the tailings of the gravity grader.

The advantages of the invention can be seen particularly well in this combination, since the product, in its entry into the compact arrangement, according to the invention, is brought into a planar layer. This planar product layer is now maintained without interruption along the entire processing distance through the compact arrangement, that is, along the distance from the screen of the size grading device via the concentrator and, finally, via the stone sorter. The dust containing air can also be guided via a duct, in a corresponding manner, into the aspiration duct, which likewise operates in a planar manner. Thus, the visual effect for the observer is that of a textile web being drawn into a printing machine, the corresponding work processes being carried out in a stepwise manner at the belt.

In a particularly interesting embodiment, the invention allows for the aspiration space, which widens toward one side, to be provided with air suction which guides the air back to the intake suction side of the stone sorter via a dust separator in recirculating air operation.

This construction brings about a very great advance in many cases of application, particularly in small and medium-sized milling installations. The invention thus makes it possible that arrangements for dry grinding preparation, which previously comprised a plurality of individual machines and in which each individual machine required good aspiration for the intensive aeration and the entire arrangement required a central air filtering system, can now be constructed as a closed compact machine.

The new invention allows all working steps to be operated in a unit with recirculating air, in many cases without filters.

In a particularly preferred construction, the gravity grading unit comprises two grading tables which are arranged one above the other and are aerated by the same air. In so doing, it is possible to construct the upper grading table as a concentrator or light grain sorter, respectively, or as a stone sorter and to construct the lower grading table as a stone sorting table. But it is also possible to construct the size grading unit from two identical screening tables (two parallel courses) which are arranged one above the other, or to use two or more different screening tables, one above the other. In addition, the grading tables are preferably arranged so as to be parallel to one another in the same grading unit.

The invention further comprises a process for dry grinding preparation of a product flow of grain type foodstuffs and feedstuffs, such as grain, namely for cleaning, separating into different fractions and preferably for sorting out foreign matter such as sand, stones, and other inclusions, wherein the product flow is transported by means of oscillating forces and air forces, respectively, via at least one size grading (screening) and subsequently via at least one gravity grading (stone sorting, light grain sorting). In so doing, the product flow, after entry into the size grading arrangement, is guided, according to the invention, without necking (so as to be spread out over a plane surface in a carpet-like manner) until the discharge of the respective sorted fraction from the respective grading unit, at the latest from the gravity grading unit.

The direction of flow and the direction of inclination of the size grading unit is preferably selected so as to be directed opposite to the direction of flow and the direction of inclination of the gravity grading unit.

Accordingly, the new invention allows not only a very great additional concentration of the working operations while maintaining controllability, but also an optimization of the individual process steps, since each work step benefits from the work step preceding it by means of the planar transfer. A product transfer via a short free fall as a product veil or carpet also helps to loosen parts of the product, so that parts which adhere together partially are detached again.

DESCRIPTION OF THE PREFERRED EMBODIMENTS

Figure 1:
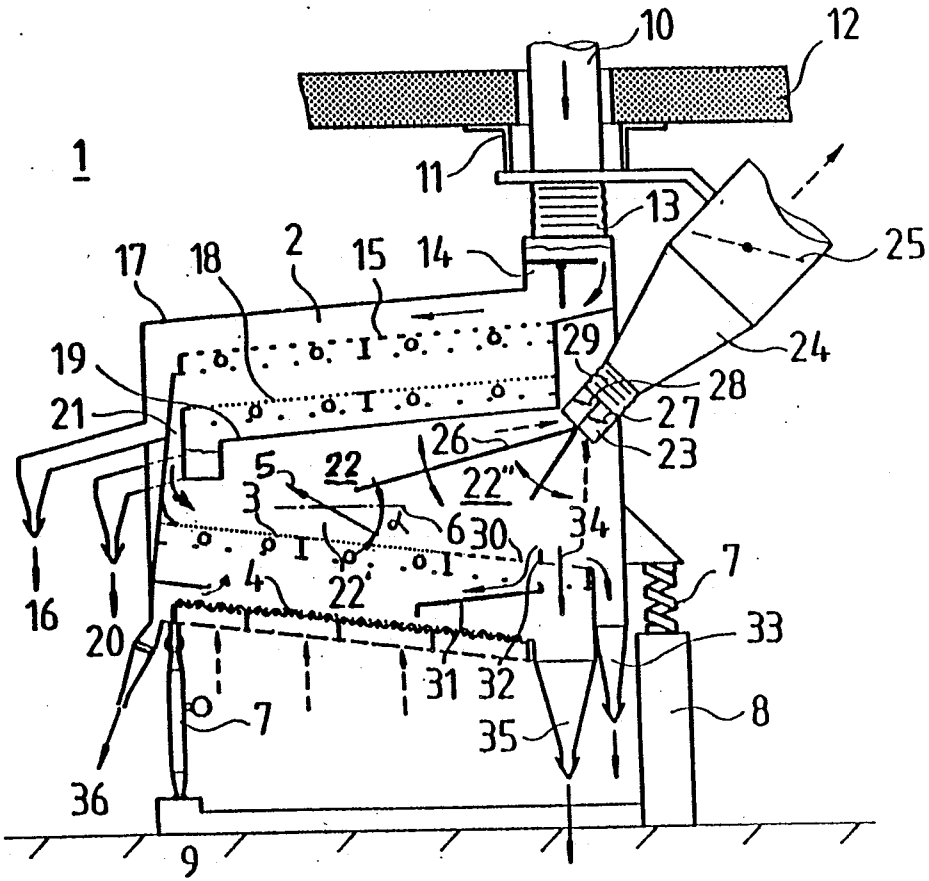
FIG. 1 shows the basic construction of a compact machine, according to the invention.

The invention will now be explained in more detail with reference to the drawing and the embodiment examples shown therein: FIG. 1 is referred to in the following. The entire arrangement comprises a compact machine containing a screening device 2 as a size grading unit, and a concentrator 3 and stone sorter 4 as gravity grading unit. An oscillation exciter is shown symbolically by means of arrow 5. Its oscillating direction is aligned at an angle, corresponding to the adjusting angle $\alpha$, relative to the horizontal plane of gravity 6 and relative to the screening device 2, the concentrator 3 and the stone sorter 4. The oscillating direction is simultaneously parallel to the drawing plane of FIG. 1 or parallel to the direction of flow of the main product, respectively. The machine 1 is supported on oscillation supports 7 via a frame 8 on the floor 9. A product feed line 10 is arranged above the screening device 2 and is connected in a fixed manner with the non-oscillating cover 12 via a suspension 11. A flexible sleeve 13, which serves as a transition from the non-oscillating parts of the machine 1 to the oscillating parts, is arranged between the product feed line 10 and the screening device 2. The region of the product inlet into the screen case 2 is constructed as a distributing case 14, so that the product flow, which is bunched together in the shape of a pipe in the product feed line 10, is spread out on the uppermost screening layer or coarse screen 15, respectively, as a flocculent, uniform product carpet. The coarse screen 15 preferably serves to remove coarse inclusions and disturbing, coarse foreign bodies such as strings, pieces of wood, etc., which are removed from the product flow via an outlet 16. The space above the coarse screen 15 is completely closed externally by a sheet-metal enclosure 17, so that there is no outward discharge of dust or exchange of air. A sorting screen 18 is located at a distance below the coarse screen 15. This sorting screen 18 comprises a relatively fine screen mesh for recovering fine constituents such as fine sand, grain fragments, etc. as screen siftings. The screen siftings are guided away, i.e. separated from the product flow, via a closed base 19, which is substantially not penetrable by air, and an adjoining sand outlet 20. The screen tailings of the sorting screen 18 flow along the entire width of the table, through a throw-off duct 21, so as to be uniformly distributed thereafter along the entire width in the manner of a product carpet, directly onto the intensively aerated concentrator 3. The throwing off of the sorting screen 18 and the subsequent reversal of the direction of flow for the main product flow in the whirl bed or fluidized bed on the concentrator 3 has a twofold function. On the one hand, the product parts are loosened, e.g. dirt or skin parts adhering only slightly to a grain, which facilitates the subsequent division into fractions.

The other advantageous function consists in that—unlike before—the product carpet is retained in its entirety, while the substantially differing physical influences and forces, respectively, necessary for the respective processing of the portions of the product carpet can be utilized in their entirety before and after the transfer points:

before the transfer point in a product layer on a screening surface (sorting screen 18) which is not aerated after the transfer point in a classic intensively aerated whirl layer (concentrator 3).

On the screening surface which is not aerated, purely mechanical impact forces act from particle to particle The oscillated product layer seeks the greatest possible bulk density, similar to the process in concrete vibration, wherein the smallest parts immediately have the tendency to move into the vacuities of the lowest layer of larger grains. However, since the screen base is penetrable by the small particles, the latter fall through and are thus sifted out. Large parts and also parts having a greater surface area seek the upper surface of the product layer. The main forces or effects, respectively, which are utilized on the screen, result from the differing dimensions of the particles.

On the other hand, the air forces are utilized in the whirl layer as main forces. Accordingly, a very pronounced layering occurs within the whirl layer according to gravity. Grains move upward within the whirl layer, stones move downward, assuming similar sizes.

Due to the vertical throw-off of the sorting screen 18 onto the concentrator 3 and the reversal of the direction of flow, a re-layering is effected quickly, i.e. along a very short distance, from the pure agitating layer into a whirl bed layer. Neither temporary increases in capacity nor fluctuations in throughput negatively influence the quality of the re-layering—even within relatively great limits. A substantial aspect of the surprising success of the new invention consists therein.

As can easily be seen in FIG. 1, a widening space 22, which is connected to an aspiration line 24 via an exhaust connection piece 23, occurs because of the fork-shaped (or V-shaped) arrangement of the screening device 2 and the concentrator 3. The desired air quantity for operating the machine 1 can be adjusted by means of an adjusting flap 25. The widening space 22 is divided into sections 22′, 22″ by means of at least one wall 26. This allows aerations of greater or lesser intensity to be adjusted with throttle flaps 27 and 28 in one or the other sector 22′ and 22″, respectively, as required (either in the upper or in the lower portion of the fluidized bed). A flexible sleeve 29 is again arranged between the exhaust connection piece 23 and the aspiration line 24.

The object of the concentrator 3 is to layer the product flow and concentrate the specifically heavy parts in the region immediately above its table surface. A portion 30 with large product outlet openings is located shortly before the lower end of the concentrator table surface, which is penetrable by air up to this point without, however, being penetrable by product. By means of this portion 30 the lower layer, which is enriched with heavy parts, particularly stones, is discharged directly onto a slide 31 extending below it and is guided away from there to a central region of the stone sorter 4. The percentages of product flow—the proportion of the gravity concentrate on the stone sorter 4 and the proportion of the light fraction—can be determined with an adjustable product retaining shoulder 32 corresponding to the particular object to be met. The proportion of the light fraction is fed directly to a corresponding outlet 33. It is also possible to feed a medium-heavy fraction into an outlet 35 for the heavy material, that is, to the good, heavy grains, via the additional fall-through openings, symbolized by arrow 34, at the extreme lower end of the concentrator 3.

The stone sorter 4 comprises a rough surface, generally a mesh screen. The heaviest parts lying immediately on the table surface of the stone sorter 4 are conveyed to the upper table end on the left-hand side and then to a stone outlet 36 by means of the rough table surface and the throw-type oscillations of the oscillation exciter. In contrast to the stone sorter 4, the concentrator 3 comprises a table with a smooth surface (sheet metal with fine holes), so that the concentrator table surface exerts a conveying action only on the heavy product layer located closest to the table surface, despite its oscillation which is identical to that of the stone sorter 4. Due to the fluidized bed action, the product flows downward in a liquid-like manner. However, the oscillating direction common to both the concentrator 3 and the stone sorter 4 is also correct for the screening device 2. The product is conveyed downward by means of the oscillation of the screen table surface.

This shows that all three grading units, that is, the screening device 2, the concentrator 3, and the stone sorter 4, as an oscillating unit, can be provided, accordingly, with the same oscillating drive 5, and each work process can nevertheless be carried out in an optimum manner. But only the stone sorter 4 and the concentrator 3 are aerated with the same air.

All three machine parts 2, 3 and 4 are arranged, according to the invention, directly above one another. By fully utilizing the many combinable effects of the invention, the entire machine 1 has approximately only the height of a man, that is, it can be installed in any room of normal height. Participating specialists judged the surprisingly successful interplay between the screening device 2 and the concentrator unit 3 to be particularly advantageous.

However, the invention allows additional constructions.

Figure 2:
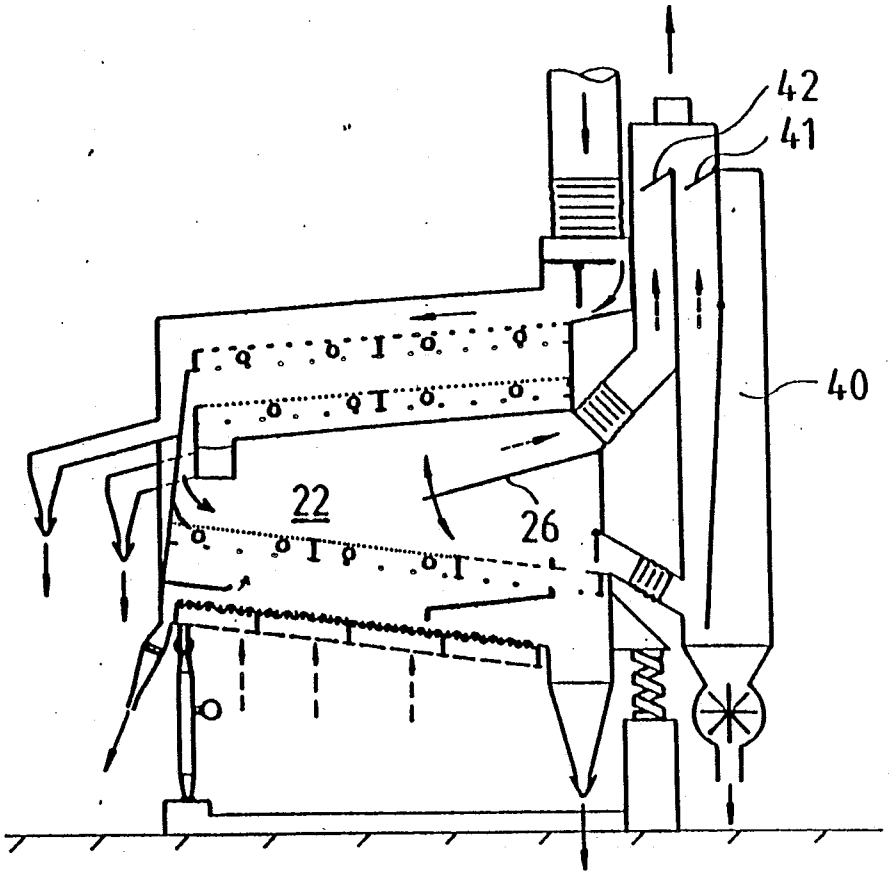
FIG. 2 substantially shows the construction, according to FIG. 1, but in combination with an aspiration stage.

Thus, according to FIG. 2, the embodiment form of the machine 1 shown in FIG. 1 can also be used in combination with a vertical aspiration duct 40. In the widening space 22, the wall 26 is preferably constructed so as to be adjustable, so that the air quantity distribution on the concentrator surface can be adjusted within certain limits, but particularly so that the air required in the aspiration duct 40 can be adjusted separately by means of a throttle 41. The air quantity, which is suctioned out of the upper portion of the space 22, can be adjusted by means of a control flap 42.

In the embodiments according to FIGS. 1 and 2, the base of the stone sorter 4 is penetrable by air, so that the air can flow freely into and through the stone sorting table from the bottom. Both embodiments work by a so-called suction operation, which is also a great advantage for an easy control of the aeration.

Figure 3:
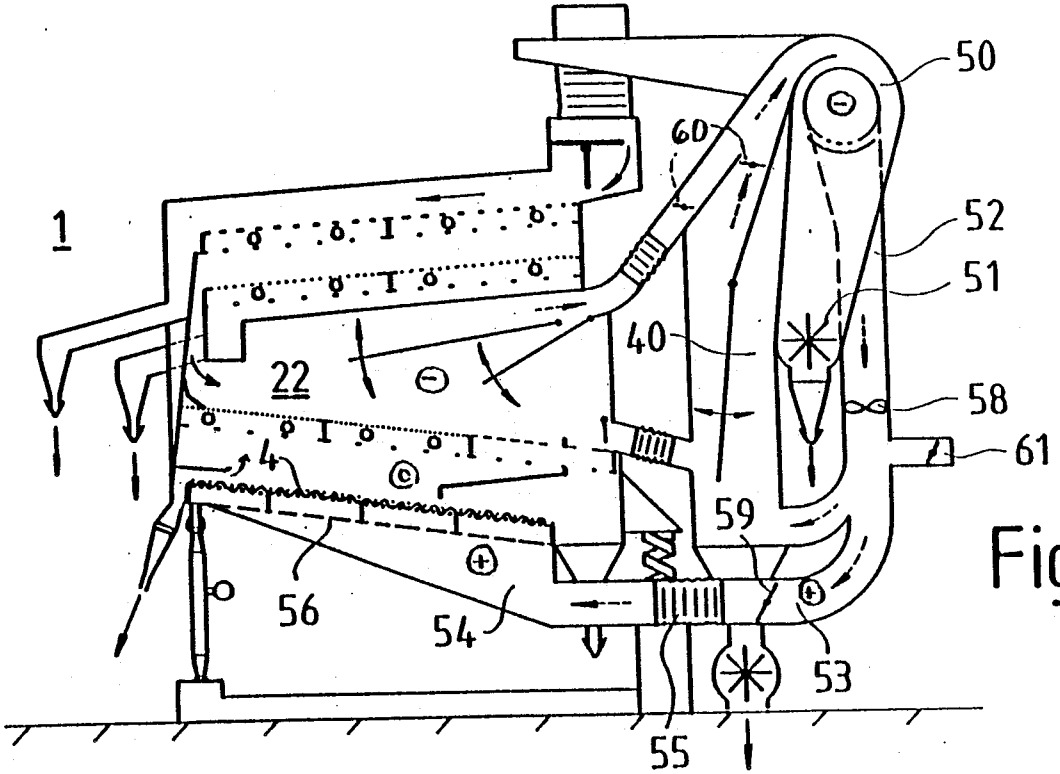
FIG. 3 substantially shows a solution corresponding to FIG. 2, but with recirculating air operation and an additional separator.

The construction of FIG. 3 comprises the structural elements of the solution according to FIG. 2, but is developed further in a fundamental function. Namely, it enables the machine 1 to be operated completely with recirculating air and comprises a light portion separator for this purpose.

The exhaust from the aspiration duct 40 is led directly into a circular separator 50. In the circular separator, dust and skin parts are separated from the air with a very high separating efficiency and can be discharged via a dust air lock 51. The working air is returned to the grading section through a duct 52 and a return line 53. For this purpose, the space below the stone sorter 4 is completely closed externally by means of an air distributing case 54. The air distributing case 54 is a part of the oscillating unit and is connected with the return line 53 via a flexible sleeve 55. The stone sorter is constructed in the sandwich-type construction method, known per se, which, at the bottom, comprises a plate 56 with very fine holes, so as to ensure a good air distribution on the table surface of the stone sorter 4.

In addition, a small filter, not shown, can be assigned to the machine 1 downstream of an exhaust connection piece 61 in the event that no aspiration arrangement is available. The desired pressure distribution in the arrangement can be adjusted, as indicated by the circled signs + and − as symbolic pressure values, via corresponding air flaps 59 and 60 by means of a fan 58 which is preferably arranged downstream of the circular separator 50.

Should the machine 1 not be operated with recirculated air, the corresponding parts are not required. Nevertheless, the circular separator 50 can be used and the exhaust air can be sucked off, for example, by means of an aspiration arrangement, via the exhaust connection piece 61.

Figure 4:
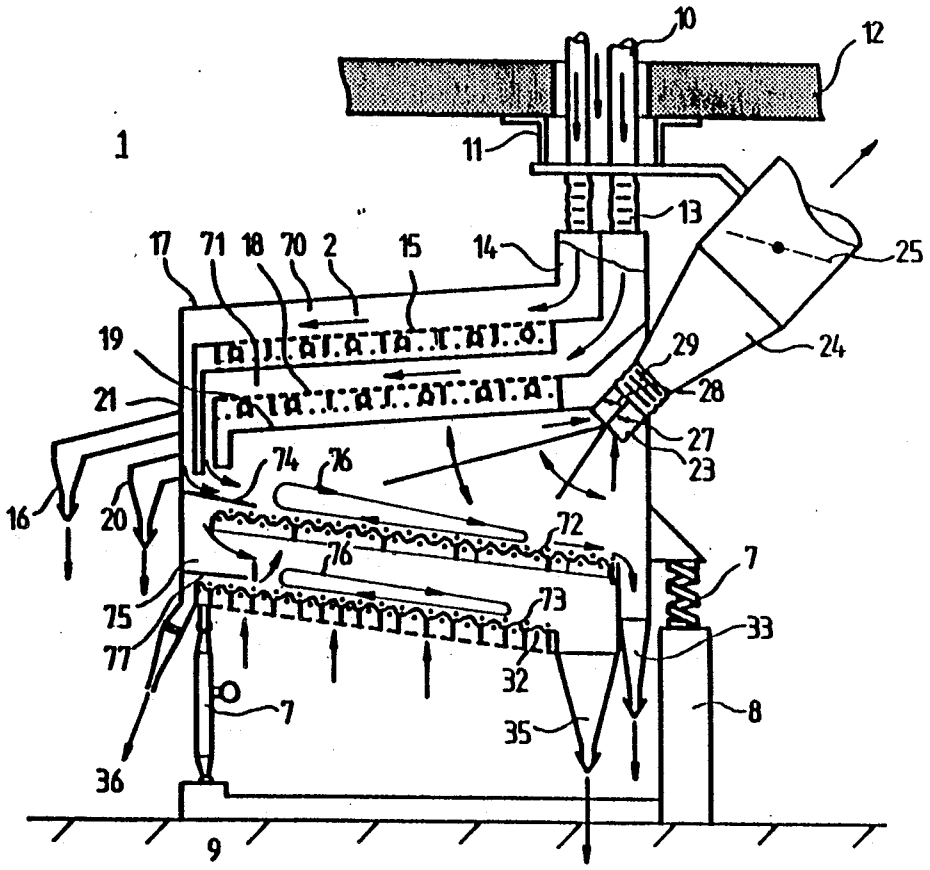
FIG. 4 substantially shows a solution, according to FIG. 1, but with two stone sorting tables, which are arranged one above the other, and a parallel course for the screening.

FIG. 4 shows a particularly advantageous combination of the new invention. Two parallel screening courses 70 and 71 are provided for the size grading, wherein the screen siftings (very fine sand and broken pieces of grain) are guided away from the correspondingly closed bases via outlets 16 and 20, respectively.

Two stone sorting table surfaces 72, 73, each of which comprises a product support in the form of a mesh screen, are provided for the gravity grading, that is, particularly for the stone sorting. The oscillating motion transmits a strong transporting action to the heavy material lying immediately on the upper or lower table surface 72, 73, respectively, after the higher end of the table. The light material is lifted from the two table surfaces by means of the strong, uniformly distributed air flow, floats in the direction of the lower table ends and is removed via the outlets 33 and 35, respectively.

It is interesting to note that, on the higher of the two stone sorting tables 72, 73, a heavy fraction, e.g. 30 to 60%, of the total volume of material flows under an inlet plate 74, then into a transfer location 75 so as to then fall directly onto the lower table surface 73. The upper table surface 72 only produces a mixture with all heavy material which is transferred to the lower table near the upper table end, e.g. as 50% of the total quantity. Doubts on the part of specialists to the effect that feeding the material near the upper table end of the gravity grading automatically leads to poor stone sorting, were able to be refuted by tests. It has been shown that a previously unattainable stone sorting quality is achieved by means of the very strong layering flow indicated by circulation lines 76. Both a strong upward transport and a strong downward flow occur in the vicinity of the table.

The actual stone separation first takes place between the lower table surface 73 and a guide plate 77 provided above the upper end of this table. Due to the air flow in this region, which is guided in the opposite direction to the movement of material, the stones are conveyed with only a slight proportion of grain and, finally, are removed by means of the rubber-tube lock 36.

A particularly great advantage of the design variant, according to FIG. 4, consists in that the throughput through the various process zones is adaptable to the respective specific requirements of the individual machine parts in a very accurate manner. Since all tables have an approximately identically dimensioned working surface, the screen surface and also the actual stone sorting surface are doubled, since the lowest table surface only obtains a portion of the total quantity. This allows a very high screening and stone sorting quality with a high product throughput.

Figure 5:
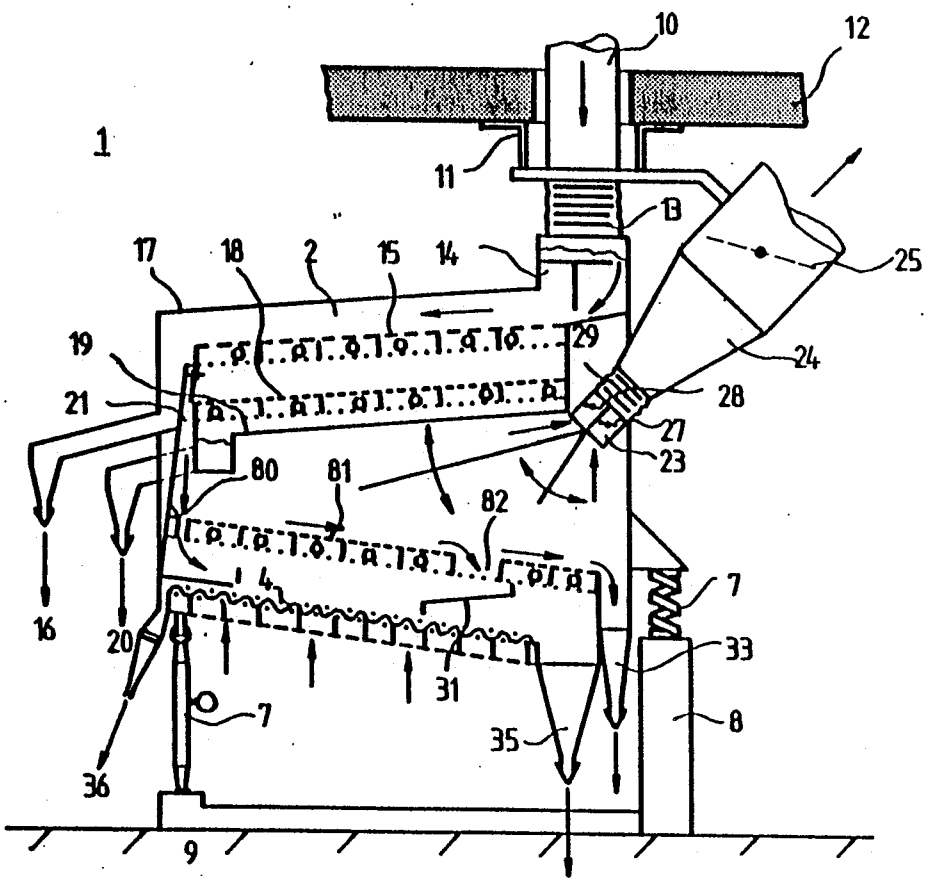
FIG. 5 shows another embodiment variant for the gravity grading comprising an upper concentrator or light grain sorter, respectively, and a lower stone sorting table.

In contrast to FIG. 1, FIG. 5 shows another advantageous construction. The lowest table surface serves for stone sorting. A table 81 located above the latter has a table surface which is somewhat less rough, so that a portion of the stones with a small quantity of grain material can be conveyed upward and can fall downward directly onto the stone sorting table 4 via a through-opening 80. The upper table 81 of the gravity grading arrangement serves primarily as a layering table and comprises a "material sump" 82 in the lower part, i.e. a trough-shaped depression, in which the totality of heavy material (heavy grains), including the stones, accumulates. The gravity fraction from the material sump 82 is let down via the base openings 30 and fed to the stone sorting table 4 via the slide 31.

Besides the very high stone sorting quality, the great advantage of this variant consists in a very good separation, e.g. into heavy grain material, which is removed via the outlet 35, and into light grain material, which is removed via the outlet 33.

In its entirety, the invention comprises a process and a machine (1) for dry cleaning of grain type foodstuffs and feedstuffs such as grain. The separation of the material to be cleaned into various fractions is carried out in a single oscillating group. The latter comprises a size grading unit (2) situated above, which can comprise a desired screen combination (15,18;70,71), preferably has a closed lower base, and is arranged directly above a gravity grading unit (3,4;72,73;81), preferably in such a way that the two grading units are arranged in a fork-shaped or V-shaped manner relative to one another. The gravity grading unit (3,4;72,73;81) can likewise be combined in various variants, for example as a single or double layering table or as upper layering table and lower stone sorting table. The fork-shaped intermediate space (22) serves for the guiding of air for the gravity grading tables. A major advantage is that the material to be cleaned is guided uninterruptedly in a planar manner from the entry into the machine 1 until the discharge in the manner of a spread out textile web and is transferred from one part of the machine to the other (grading unit to grading unit). In contrast to the concept of the known cleaning arrangements or arrangements for dry grinding preparation, respectively, constructed from individual machines, a single compact machine is provided, according to the invention, operating without bunching together of the material beween different steps of the process.

I claim:

1. Process for preparation prior to grinding of a product flow of grain type foodstuffs and feedstuffs such as grain, namely for cleaning, separating into different fractions and particularly for sorting out foreign matter such as sand, stones, and other inclusions, comprising the steps:

(a) distributing said product flow at an upper inlet end of a generally planar size screening unit for separation by size, said size screening unit being inclined to a horizontal plane and having said upper inlet end and a lower outlet end;

(b) spreading said product flow over said screening unit in a carpet-like manner;

(c) conveying said product flow along said screening unit by means of oscillating forces applied to said screening unit, only a product fraction containing all of the grain type food-/feed stuffs reaching said lower outlet end;

(d) transferring said product fraction from the outlet end of said size screening unit to an upper end of a gravity grading unit positioned below said size screening unit and inclined oppositely thereto and forming a V-shaped aspiration space therebetween;

(e) maintaining said spread of said product fraction in said carpet-like manner during said transfer;

(f) conveying said product fraction through said gravity grading unit by means of oscillatory forces and additionally by air flow;

(g) using a single throw-type oscillation drive to provide said oscillatory forces for accomplishment of steps (c) and (f) and providing said air flow through said gravity grading unit and said V-shaped aspiration space for accomplishment of step (f), whereby said product on said size screening unit is conveyed with downward oscillatory force components, said product fraction is stratified in said gravity grading unit and upward oscillatory force components are applied for conveying said product fraction in said gravity grading unit.

2. A compact machine for preparation prior to dry grinding of a product flow of grain type foodstuffs and feedstuffs, said machine cleaning, separating into different fractions and sorting out foreign matter, said matter including sand, stones and other inclusions, comprising:

a size grading unit having an inlet end and an outlet end receiving an input of said product flow;

a gravity grading unit receiving from the outlet end of said size grading unit a fraction of said input, said fraction including said foodstuffs and feedstuffs, said size grading unit and said gravity grading unit forming a unitary oscillating group and moving in unison and being positioned one above the other with their longitudinal axes disposed in vertically diverging planes to create a V-shaped aspiration space between them;

means for transferring said fraction of said foodstuffs and feedstuffs in the manner of a product carpet or veil falling from said outlet of said size grading unit onto said gravity grading unit located therebelow; and means for producing an air flow through said V-shaped space, said air flow being drawn out of said space by said air flow producing means.

3. A compact machine as claimed in claim 2 wherein said means for producing the air flow includes a base impervious to said air flow which base closes said size grading unit (2) from beneath.

4. A compact machine as claimed in claim 2, wherein said size grading unit (2) includes two screening tables positioned one above the other.

5. A compact machine as claimed in claim 2, and further comprising a dust separator, and wherein said air flow producing means includes an air exhaust, said exhaust returning said air to said gravity grading unit (4) via said dust separator (50, 51) in recirculating air operation.

6. A compact machine as claimed in claim 2 wherein said size grading unit includes at least one screen for sifting.

7. A compact machine as claimed in claim 2, wherein said gravity grading unit is a stone sorter (4, 72, 73).

8. A compact machine for preparation prior to dry grinding of grain type foodstuffs and feedstuffs, said machine cleaning, separating into different fractions and sorting out foreign matter, said matter including sand, stones and other inclusions, comprising:

a size grinding unit;

a gravity grading unit;

said size grading unit and said gravity grading unit forming an oscillating group, said units being positioned one above the other with a V-shaped aspiration space existing between them;

means for transferring a product flow of said foodstuffs and feedstuffs in the manner of a product carpet or veil falling from said size grading unit onto said gravity grading unit located below; and means for producing an air flow through said V-shaped space, wherein said gravity grading unit includes two grading tables, said two grading tables being arranged one above the other and aerated in series by the same air of said air flow.

9. A compact machine as claimed in claim 8, wherein said upper grading table is constructed as one of a concentrator (3, 81), light grain sorter, and a stone sorter (72), and said lower grading table is constructed as a stone sorting table (4, 73).

10. A compact machine as claimed in claim 8, wherein said grading tables are positioned in parallel to one another in the same gravity grading unit.

11. A compact machine for preparation prior to dry grinding of grain type foodstuffs and feedstuffs, said machine cleaning, separating into different fractions and sorting out foreign matter, said matter including sand, stones and other inclusions, comprising:

a size grinding unit;

a gravity grading unit, said size grading unit and said gravity grading unit forming an oscillating group, said units being positioned one above the other with a V-shaped aspiration space existing between them; said oscillating group includes an oscillating drive operating jointly on said size grading unit and said gravity grading unit, said oscillating drive is arranged at both sides, approximately on a horizontal plane of gravity, of the entire oscillating group, a throw-type oscillation being generated with upward components for said gravity grading tables and with downward components for said size grading tables, means for transferring a product flow of said foodstuffs and feedstuffs in the manner of a product carpet or veil falling from said size grading unit onto said gravity grading unit located below; and means for producing an air flow through said V-shaped space.

12. A compact machine for preparation prior to dry grinding of grain type foodstuffs and feedstuffs, said machine cleaning, separating into different fractions and sorting out foreign matter, said matter including sand, stones and other inclusions, comprising:

a size grading unit;

a gravity grading unit;

said size grading unit and said gravity grading unit forming a unitary oscillating group, said units being positioned one above the other with a V-shaped aspiration space existing between them;

means for transferring a product flow of said foodstuffs and feedstuffs in the manner of a product carpet or veil falling from said size grading unit onto said gravity grading unit located below; and means for producing an air flow through said V-shaped space, said means for producing the air flow includes a base impervious to said air flow which base closes said size grading unit from beneath, wherein said gravity grading unit includes a gravity grading table, and said means for producing said air flow comprises a suction fan connected to the wide-end side of said space located between said closed base and said gravity grading table.

13. A compact machine as claimed in claim 12, wherein said aspiration space (22) is divided into at least one upper (22″) and one lower (22′) exhaust chamber, and further comprising adjustable air throttles (27, 28) positioned in said air flow and adapted to regulate air flow in each said chamber respectively.

14. A compact machine as claimed in claim 12 or 13, and further comprising a vertical aspiration duct in the path of said air flow, and a concentrator table for sorting a light fraction from the tailings, said concentrator table being located between said size grading unit and said gravity grading unit and at an angle to the horizontal, the lower end of said concentrator table opening directly into said vertical aspiration duct (40).

* * * * *